United States Patent [19]

Francis

[11] 4,410,182

[45] Oct. 18, 1983

[54] ARITHMETIC DICE GAMEBOARD

[76] Inventor: David D. Francis, 5041 Linette La., Annandale, Va. 22003

[21] Appl. No.: 285,502

[22] Filed: Jul. 21, 1981

[51] Int. Cl.[3] ..... A63F 3/00

[52] U.S. Cl. ..... 273/268; 273/DIG. 26

[58] Field of Search ..... 40/154; 273/260, 268, 273/271, 286, 287, DIG. 2, DIG. 26; 434/96, 203, 408, 409, 410

[56] References Cited

U.S. PATENT DOCUMENTS

| | | | |
|---|---|---|---|
| 657,522 | 9/1900 | Deiters | 273/DIG. 26 |
| 1,127,594 | 2/1915 | Cooper | 273/286 X |
| 1,694,405 | 12/1928 | Troidl | 434/203 |
| 2,404,563 | 7/1946 | Berliner | 434/410 |
| 3,251,600 | 5/1966 | Warnberg | 273/287 X |
| 3,508,348 | 4/1970 | Harada | 434/203 |

FOREIGN PATENT DOCUMENTS

| | | | |
|---|---|---|---|
| 604005 | 1/1926 | France | 273/268 |
| 1544833 | 9/1968 | France | 273/268 |
| 676879 | 8/1952 | United Kingdom | 273/287 |
| 1345428 | 1/1974 | United Kingdom | 273/268 |

*Primary Examiner*—Harland S. Skogquist

*Attorney, Agent, or Firm*—Laurence R. Brown; Laurence R. Brown

[57] ABSTRACT

A gameboard comprises a dice rolling surface surrounded by a decorative rim. On the edges of the surface are integrally mounted one set of numerical indicia implicit in playing the game and a set of movable beads for keeping score. Only a pair of dice are removably held in a compartment along one edge. Thus, the entire board is fashioned for storing by hanging as a picture on the wall. The indicia used in playing the game comprises in a preferred embodiment a set of cubes mounted eccentrically on a rod to have two stable pivot positions displaying respectively the indicia and masking it. The gameboard is adapted for arithmetic education and entertainment by players of all ages. It includes features for stabilizing the aforesaid indicia and scoring means to prevent accidental misplacement but being changeable by manual force.

3 Claims, 4 Drawing Figures

FIG. 1
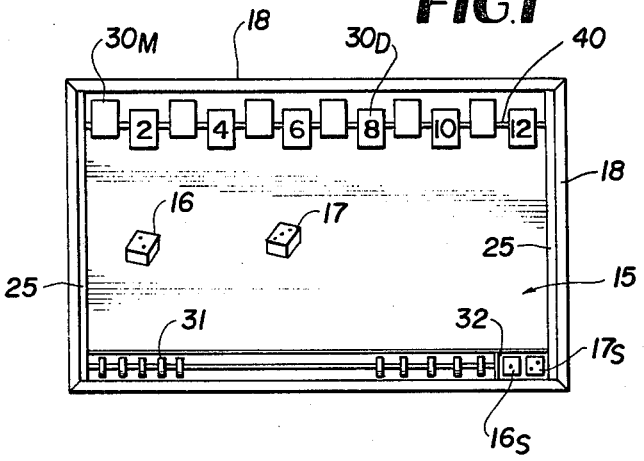
FIG. 2
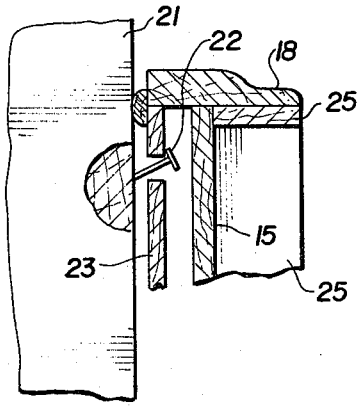
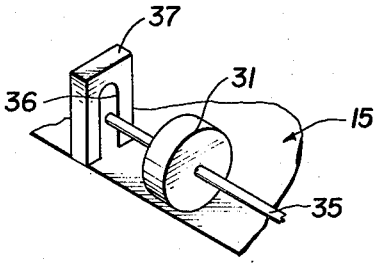
FIG. 3
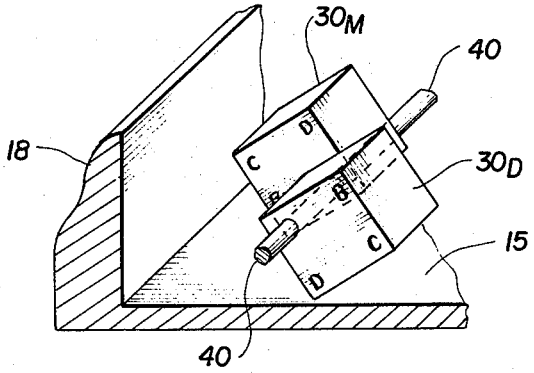
FIG. 4

ARITHMETIC DICE GAMEBOARD

TECHNICAL FIELD

This invention relates to games and more particularly it relates to gameboards for playing arithmetic games on which dice are rolled.

BACKGROUND ART

Gameboards on which dice are rolled are well known, such as craps and Backgammon. Some examples of patented games include J. B. Cooper U.S. Pat. No. 4,114,290—Sept. 19, 1978; F. Tintorer U.S. Pat. No. 2,969,238—Jan. 24, 1961; and J. F. Carroll U.S. Pat. No. 4,247,114—Jan. 27, 1981.

The objective of the Cooper game is to teach arithmetic relationships recreationally, which is also an objective of this invention.

Furthermore, most dice rolling games are playable with removable separate scorekeeping tokens, pieces, cards, etc., and are always subject to loss or mutilation of the side pieces, which changes odds or ruins the game objectives. Storage of these separate items is also inconvenient when the game is not in use. Thus, an objective of this invention is to provide a self-contained gameboard complete with playing indicia noting game progress and scorekeeping means wherein the only removable elements comprise a set of dice.

Also, most gameboards have necessary movable elements so sensitive to displacement that the gameboards cannot be jarred during play. Thus, one cannot play on a lap as when in an aircraft, and an accidental nudge might ruin a game in progress. Even the jar from throwing of dice on the board can cause vibrational changes in the position of movable elements. Another objective of this invention therefore is to provide gameboards with attached indicia that hold a desired stable position over large ranges of board movement and shock.

Accessible storage of games is also a problem in the prior art. Pieces may be lost in a storage chest, and it is sometimes tedious to assemble a game in readiness for play. Also most games are unsightly in a decorative sense and are displayed only for playing the game. It is thus another objective of this invention to provide a decorative game that can be stored in assembled form ready for instant play and which can be hung like a decorative picture in a gameroom.

Other objects, features and advantages of the invention will be found throughout the following description, the drawing and the claims.

DISCLOSURE OF THE INVENTION

The self-contained decorative gameboard of this invention, which has a surface adapted for rolling dice and corresponding integral self-contained indicia for denoting progress of the game, is decoratively stored ready to play like a picture on a gameroom wall. This is accomplished by a non-interfering mounting element and means frictionally grasping the dice (which are the only removable elements) in visible position when stored.

Along the edges of a dice rolling surface, disposable horizontally to sit on a table or the like, are indicia for denoting progress of a game in play. This includes a set of indicia elements for denoting separate numbers that individually attain a bistable state positioning by manual action to selectively display and mask the numbers. Typically indicia elements are cubes mounted eccentrically on a rod so that two different edges rest on the board surface by gravity in respective selected stable positions masking and displaying the indicia number.

Also scorekeeping beads movable along a rod are disposed along one edge of the board surface and are gravity biased into frictional contact with the playing surface, or the like to hold their scoring position until manually forced to another scoring position. All elements are self-contained as an integral part of the gameboard disposed on the gameboard playing surface except for a removable pair of dice.

BRIEF DESCRIPTION OF THE DRAWINGS

In the drawings:

FIG. 1 is a plan view of the gameboard afforded by this invention;

FIG. 2 is a fragmental section end view showing the gameboard stored as a picture;

FIG. 3 is a fragmental perspective view showing the scoring bead frictional mount feature of the invention;

FIG. 4 is a perspective view fragmented sketch, and partly in section of a preferred embodiment of the indicia selection feature of the invention.

DETAILED DESCRIPTION OF THE PREFERRED EMBODIMENT

In the plan view of FIG. 1, the general gameboard layout is viewed. Thus, a quadrilateral, preferably rectangular sheet having a playing surface 15 for rolling a pair of dice 16, 17 is defined by decorative fencing rim members 18 extending uprightly from the playing surface when disposed horizontally for rolling the dice. It is seen in more detail in FIG. 2. The bottom of the board is provided with felt feet or the like (not shown) so that the board may rest on a table surface without scratching, etc. Also some hanging means, preferably indented in the bottom of the board as with aperture 20, is provided to permit the decorative gameboard to be stored as a picture on the wall 21 by hanging on nail 22, for example. This is readily accomplished with a false bottom layer 23 below the playing surface 15. The playing surface is preferably covered with billiard table felt to provide proper conditions for rolling the dice 16, 17 as is the border insert rim panel 25 against which the dice may be bounced.

As seen from FIG. 1, mounted along two respective edges of the playing surface, which can be adjacent edges if desired, are a set of manually selectively movable elements 30 which serve to mask or display corresponding numerical indicia during game play. Also provided is a set of movable beads 31 for scoring. A pair of dice 16*s*, 17*s* are storable in frictional grasp, such as by tight fit in a felt lined cell, in compartment 32 along the bead axis, so that they are retained when the board is stored by hanging on the wall.

Construction of the scoring bead set is illustrated in FIG. 3, where beads 31 are strung along coaxial rod 35 for axial movement therealong. By mounting rod 35 in slot 36 of end pieces 37, it is seen that the beads 31 rest frictionally by force of gravity on surface 15', which may be the felt covered playing surface or similar frictional surface which the beads contact. This feature holds the scoring beads in place until manually forced to a different location and prevents accidental impact or vibration caused by throwing dice from moving the beads 31 along rod 35.

The movable indicia elements 30 for displaying individual numbers are cubes similar to well known building blocks but having indicia on only one face. Thus they are made movable by rotation to rest in one of two stable positions, namely 30D for displaying the numerical indicia or 30M for masking the numerical indicia. A preferred embodiment is shown in FIG. 4 where the location of the coaxial rod 40 provides a desirable unbalance to the center of gravity which tends to improve the stability of the rest position by additional gravity bearing force.

These elements 30 are strung eccentrically on the rod 40 near one corner A so that the elements 30 may be pivoted into either of the bistable positions, namely display position 30D with corner D contacting the playing surface 15 or masking position 30M with corner B contacting the playing surface 15. It is seen therefore that the location of the coaxial rod 40 through the cube enables an eccentric pivot mount position and serves to retain the elements bistably in each one of the two desired pivot positions. The indicia elements are manually flipped as the game is played to indicate game progress. Typically numbers 1 to 12 are displayed on corresponding individual elements, though a lesser number of elements providing for, e.g. numbers 1–8, may be employed to comprise the total game field. The lower the number of elements and denomination of numbers hastens the time of game play and simplifies the arithmetic involved.

The gameboard therefore provides a recreational game involving a mixture of chance and skill suitable for all ages. It has also an arithmetic teaching value particularly for children because it requires adding, grouping and selection of numbers.

Although other rules and variations may be adopted, typical game rules are as follows:

For playing a game, a field is selected from all numbered indicia elements to a part, such as numbers 1 to 8 or all odd numbers. The object of the game is to run the gamut. That is all numbers should be eliminated by masking by matching with numbers from thrown dice on successive throws without leaving a remainder. Thus, a 6+2 dice throw permits removal or masking of 8, 7 and 1, 6 and 2, or 5 and 3, etc. Every throw challenges a player to make a reasoned selection. Conversely if all numbers are masked except 8, such must be masked by a dice roll of 8 with either 6+2, 5+3 or 4+4 showing to win the game by running the gamut.

The scoring beads may be evenly divided between two players, and one bead moved for each game to the side of the winner, who would be either the player if he runs the gamut or the opponent if he fails to run the gamut. A match is finished when one player collects all the beads.

Note that several features of the gameboard are important for example, ability to play on the lap and to store decoratively on the wall. Features include (1) integral parts on the board except for the dice, which are frictionally held in stored position by tight fit into a frictional surface, such as felt, (2) movable numeral indicia selectors and scoring beads so biased by gravity, mounted and frictionally held that they are not likely to be dislodged accidentally by jarring of reasonable tilting of the board over a large tilting angle nor by vibration caused by successive impacts of the rolling dice, and (3) picture mounting means recessed on the back to avoid contact with a wall or with a table upon which the game is played to scratch or mar such.

Those features of novelty believed descriptive of the spirit and nature of the invention are defined with particularity in the claims.

I claim:

1. A board game comprising in combination, a substantially quadrilateral open topped board disposed to rest horizontally, upright fencing means extending upwardly about the edges of said board, a rod mounted horizontally along one edge of the board, a set of eccentrically mounted cubical indicia elements having different indicia numbers on one cubical face of the respective elements disposed along said rod along said one edge of said board adjacent said fencing means for displaying individual numbers selectively one by one, said cubical elements defining an aperture through the cubical element substantially parallel with one edge and off center towards said edge, through which aperture the rod is passed thereby to establish two stable pivoted positions of the elements on the rod of said cubical face with the numbers to show visibly when viewing the board in one stable position with one cube edge contacting the playing surface and to be hidden in the other stable position with another cube edge contacting the playing surface, a pair of dice, means for storing the dice visibly in frictionally retained position when not in use disposed along an edge of said board adjacent said fencing means, scoring means comprising a string of beaded elements disposed along an edge of said board adjacent said fencing means, and a central playing surface on said board surrounded by the fencing means and abutting the means disposed along an edge of the board adapted as a field for rolling the dice with a decorative playing surface to be disposed on a table surface or the like for playing the game adapted to hang on a wall like a picture in a ready to play condition by means of recessed anger means on the opposite side to the playing surface that avoids contact with said wall wherein the playing surface is adapted for rolling dice as the game is played, and including frictional grasping means visibly storing the dice and retaining them in place when the playing surface is disposed vertically and having display means with a set of indicia elements movable as the game is in progress including means holding the set of indicia elements in a decorative position when the game is hung like a picture.

2. A board game played with a pair of dice comprising therewith, a playing surface disposable to rest horizontally and adapted for rolling the dice thereon, and manually operable scoring display means integrally disposed adjacent said surface comprising a rod mounted parallel said surface with a set of eccentrically disposed cubical elements disposed thereon by apertures defined therethrough parallel to one edge and off center nearer one edge for pivoting the elements between two bistable positions with one indicia face on each element carrying an indicia character for matching a possible roll of the dice displayed for visibility in one bistable position and masked in the other for selectively displaying and masking a set of individual indicia such as numbers to indicate game progress in response to manual pivoting of one or more elements with the indicia obtained by a rolling of the dice wherein the rod is disposed through the cube between two parallel faces at a position off center toward a first cube edge and the rod is disposed to permit the two diametrically opposed cube edges adjacent the first cube edge to contact said playing surface thereby to produce the respective bistable state positions.

3. The game of claim 2 adapted to rest on a table surface or the like when the game is played to hold the playing surface horizontal, further comprising, a decorative picture frame type rim about said board, and hanging means disposed on the downwardly disposed side of the surface when horizontal without interference with the horizontal position of the surface or contact with the surface upon which the board rests, thereby to receive a wall disposed member for retaining the game on a wall like a picture.

* * * * *